United States Patent [19]

Schumacher

[11] 4,408,621

[45] Oct. 11, 1983

[54] APPARATUS FOR TRANSFERRING CIGARETTES OR THE LIKE

[75] Inventor: Peter Schumacher, Hamburg, Fed. Rep. of Germany

[73] Assignee: Hauni-Werke Körber & Co. KG., Hamburg, Fed. Rep. of Germany

[21] Appl. No.: 271,857

[22] Filed: Jun. 9, 1981

[30] Foreign Application Priority Data

Jun. 19, 1980 [DE] Fed. Rep. of Germany ..... 3022827

[51] Int. Cl.[3] ..... A24C 5/32; A24C 5/33; A24C 5/35

[52] U.S. Cl. ..... 131/282; 131/283; 198/478

[58] Field of Search ..... 198/480, 478, 689, 800; 131/282, 283

[56] References Cited

U.S. PATENT DOCUMENTS

| | | | |
|---|---|---|---|
| 3,303,926 | 2/1967 | Pohl | 198/478 |
| 3,567,011 | 3/1971 | Pinkham | 198/478 |
| 4,051,947 | 10/1977 | Schumacher et al. | 198/478 |

*Primary Examiner*—V. Miller

*Attorney, Agent, or Firm*—Kontler, Grimes & Battersby

[57] ABSTRACT

Apparatus for transferring cigarettes from a first station where the cigarettes arrive by moving axially to a second station which the cigarettes leave by moving sideways has a rotary carrier for several hollow crank arms which are rotatably mounted in the carrier and whose free ends are provided with rotary receiving devices for retention and transport of cigarettes from the first to the second station while the carrier rotates in response to rotation of an eccentric holder which is driven by the prime mover of the cigarette making machine. The holder transmits motion to discrete crank units which cooperate with universal joints and cardanic shafts to prevent changes in orientation of receiving devices during orbital movement of receiving devices about the axis of the carrier. The crank arms can turn back and forth in response to rotation of the carrier with reference to a stationary cam which is tracked by levers, one for each crank arm and each transmitting motion to the corresponding crank arm by way of a discrete gear train.

13 Claims, 4 Drawing Figures

APPARATUS FOR TRANSFERRING CIGARETTES OR THE LIKE

BACKGROUND OF THE INVENTION

The present invention relates to apparatus for transferring rod-shaped articles, such as cigarettes or filter rod sections, from a first station at which the articles arrive by moving axially to a second station which the articles leave by moving sideways, or vice versa. More particularly, the invention relates to improvements in transfer apparatus of the type wherein articles leave the first station at a first speed and move away from the second station at a different second speed. Still more particularly, the invention relates to improvements in transfer apparatus of the type wherein a rotary carrier supports several crank arms each of which carries or is provided with a receiving means for one or more rod-shaped articles. The crank arms are equidistant from the axis of rotation of the carrier and their movements are controlled by transmission means to ensure that the crank arms are moved relative to the carrier while the latter rotates as well as that the orientation of the receiving means remains unchanged during transfer of articles from one of the stations to the other station.

Transfer apparatus of the above outlined character are often installed between a maker (e.g., a cigarette making machine) and a processing machine (e.g., a filter tipping machine which assembles plain cigarettes of double unit length with filter rod sections of double unit length to form filter cigarettes of double unit length). As a rule, cigarettes leave a maker by advancing lengthwise (i.e., axially), and successive cigarettes or groups of cigarettes enter the filter tipping machine by moving sideways. A suitable maker is known as GARANT and is produced by the assignee of the present application. Another maker is known as SE 80 (also produced by the assignee of the present application), and a filter tipping machine which can cooperate with either of the aforementioned makers is known as MAX S (produced and sold by the assignee of the present application). Certain heretofore known transfer apparatus which are utilized to transport plain cigarettes from a maker to a processing machine are disclosed in U.S. Pat. No. 3,303,926 granted Feb. 14, 1967 to Ernest E. Pohl, in U.S. Pat. No. 3,567,011 granted Mar. 2, 1971 to Jesse R. Pinkham, in German Utility Model No. 1,972,850 in U.S. Pat. No. 4,051,947 granted Oct. 4, 1977 to Peter Schumacher et al., in U.S. Pat. No. 3,521,513 granted July 21, 1970 to Gömann et al., in U.S. Pat. No. 3,952,865 granted Apr. 27, 1976 to Rudszinat, in U.S. Pat. No. 4,244,250 granted Jan. 13, 1981 to Ridszinat, and in commonly owned copending patent application Ser. No. 271,834 filed June 9, 1981 by Schumacher. FIGS. 1 to 3 of the copending application Ser. No. 271,834 are identical with FIGS. 1 to 3 of the present case.

A drawback of many presently known transfer apparatus is that they employ rather complex planetary transmissions which advance the receiving means for rod-shaped articles along elliptical or epicycloidal paths. Additional planetaries are utilized to ensure that the orientation of each receiving means remains unchanged. The number of mating gears is very large and this contributes to the cost and bulk of conventional apparatus. Furthermore, the presently known apparatus cannot ensure the transport of receiving means along an optimum path, namely, along a path which is most likely to reduce the magnitude of forces opposing a change in the direction of transport of articles from axial movement to sidewise movement or vice versa. In this connection, the proposal in the aforementioned U.S. Pat. No. 4,051,947 to Schumacher et al. constitutes a reasonably satisfactory solution because the receiving means are transported along an elliptical (rather than epicycloidal) path. Consequently, the magnitude of forces acting upon the articles is less than the magnitude of forces to which the articles are subjected during travel along epicycloidal paths. As a rule, the speed at which the articles advance during transfer onto a removing conveyor (e.g., a rotary drum-shaped conveyor having axially parallel peripheral flutes for rod-shaped articles) is much lower than the speed at which the articles travel lengthwise at the discharge end of the maker. Therefore, and if the transfer apparatus is designed in accordance with the teaching in the patent to Schumacher et al., the path for the articles must be a relatively flat elliptical path which, in turn, means that the axial speed of successive articles must be reduced quite considerably while the articles travel along a portion of the elliptical path which exhibits a very pronounced curvature, i.e., in the region of the one or the other focus of the ellipse. This can entail losses in tobacco shreds at the leading ends of rod-shaped articles (if such articles are cigarettes) during the last stage of transport to the receiving station where the articles begin to move sideways.

OBJECTS AND SUMMARY OF THE INVENTION

An object of the invention is to provide a novel and improved transfer apparatus for cigarettes or analogous rod-shaped articles which constitute or form part of rod-shaped smokers' products, and to construct and assemble the apparatus in such a way that the articles which advance from a first station to a second station can be caused to move along a path whose configuration is selected with a view to ensure optimal variations of forces acting upon the articles during transfer from the first to the second station.

Another object of the invention is to provide a transfer apparatus which is simpler, more compact and less expensive than heretofore known apparatus.

A further object of the invention is to provide the transfer apparatus with novel and improved means for guiding the receiving means during transport of articles from the first to the second station as well as during transport of empty receiving means from the second station back to the first station.

An additional object of the invention is to provide the apparatus with novel and improved means for ensuring that the article receiving means cannot change their orientation during transport of articles between the two stations.

An ancillary object of the invention is to provide the apparatus with novel and improved means for articulately mounting and supporting the receiving means.

A further object of the invention is to provide an apparatus which can be utilized with particular advantage for transfer of elongated rod-shaped articles, such as plain cigarettes, from a maker to a processing machine in such a way that variations in the speed of movement of articles during transfer from a first station to a second station do not adversely affect the shape and/or other parameters of articles.

An additional object of the invention is to provide the apparatus with novel and improved means for transferring plain cigarettes without causing losses in tobacco while the direction of movement of cigarettes is changed from axial to sidewise or vice versa.

The invention is embodied in an apparatus for transferring cigarettes or analogous rod-shaped articles between first and second stations at which the articles respectively advance axially and sideways at different first and second speeds. The apparatus comprises a rotary carrier (e.g., a hollow cylindrical body), a plurality of crank arms having first portions rotatably mounted on the carrier and second portions (the axes of rotation of first portions of the crank arms are preferably parallel to the axis of rotation of the carrier and the first portions are preferably equidistant from the axis of the carrier), article receiving means connected with and movable relative to (preferably rotatably mounted on) the second portions of the crank arms and arranged to travel, in response to rotation of the carrier, along an endless path having spaced-apart first and second portions respectively adjacent to the first and second stations (the curvature of the endless path in the region of its first portion is different from the curvature in the region of its second portion), means for preventing changes in orientation of receiving means in response to rotation of the carrier, and means for rotating the first portions of the crank arms in response to rotation of the carrier. The rotating means comprises stationary cam means, discrete lever means for each of the crank arms (each of the lever means is pivotable with reference to the carrier and has follower means for tracking the cam means so that the lever means pivot back and forth in response to rotation of the carrier), and transmission means for rotating the crank arms relative to the carrier in response to pivoting of the respective lever means.

Each transmission means may comprise a gear train. More specifically, each transmission means may comprise a sleeve or an analogous tubular element rotatably mounted in the carrier and connected to the first portion of the respective crank arm, a first gear provided on the tubular element, an intermediate shaft rotatably mounted in the carrier, a second gear mounted on the intermediate shaft and mating with the first gear, a third gear mounted on the intermediate shaft, and a fourth gear mating with the third gear and rotatable by the respective lever means so as to effect back and forth movements of the respective tubular element. The axis of each fourth gear prefeably coincides with the pivot axis of the respective lever means.

The means for preventing changes in orientation of the receiving means preferably comprise additional shafts mounted in the respective tubular elements, means for transmitting torque from the additional shafts to the respective receiving means, and means for rotating the additional shafts relative to the respective tubular elements. The means for rotating the additional shafts comprise discrete crank units for the additional shafts and each such crank has a crank pin which is eccentric to the respective additional shaft and is rotatably journalled in a driven holder which is eccentric to the carrier. The holder can be rotated by a sprocket wheel driven by the prime mover of the machine which supplies or turns out rod-shaped articles. The rotating holder cooperates with the carrier to change the angular positions of the crank units and of the associated additional shafts in response to rotation of the carrier and holder about their respective axes. Thus, the carrier is rotated in response to rotation of the holder whereby the crank units transmit torque from the holder to the carrier.

The crank arms are preferably hollow, each torque transmitting means is preferably installed in the interior of the respective crank arm. Each such torque transmitting means preferably comprises at least one universal joint, most preferably two universal joints and a cardanic shaft therebetween. One of the universal joints transmits torque from the respective additional shaft to the corresponding cardanic shaft and the other universal joint transmits torque from the cardanic shaft to the respective receiving means.

The receiving means preferably include pneumatically operated means for retaining articles therein during travel of the receiving means from one of the stations to the other station.

The cam means preferably comprises a face cam having an endless cam groove and the tracking means may comprise roller follower means provided on the lever means and extending into the groove. The cam means and the lever means can be installed in the interior of the carrier.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENT

Figure 2:
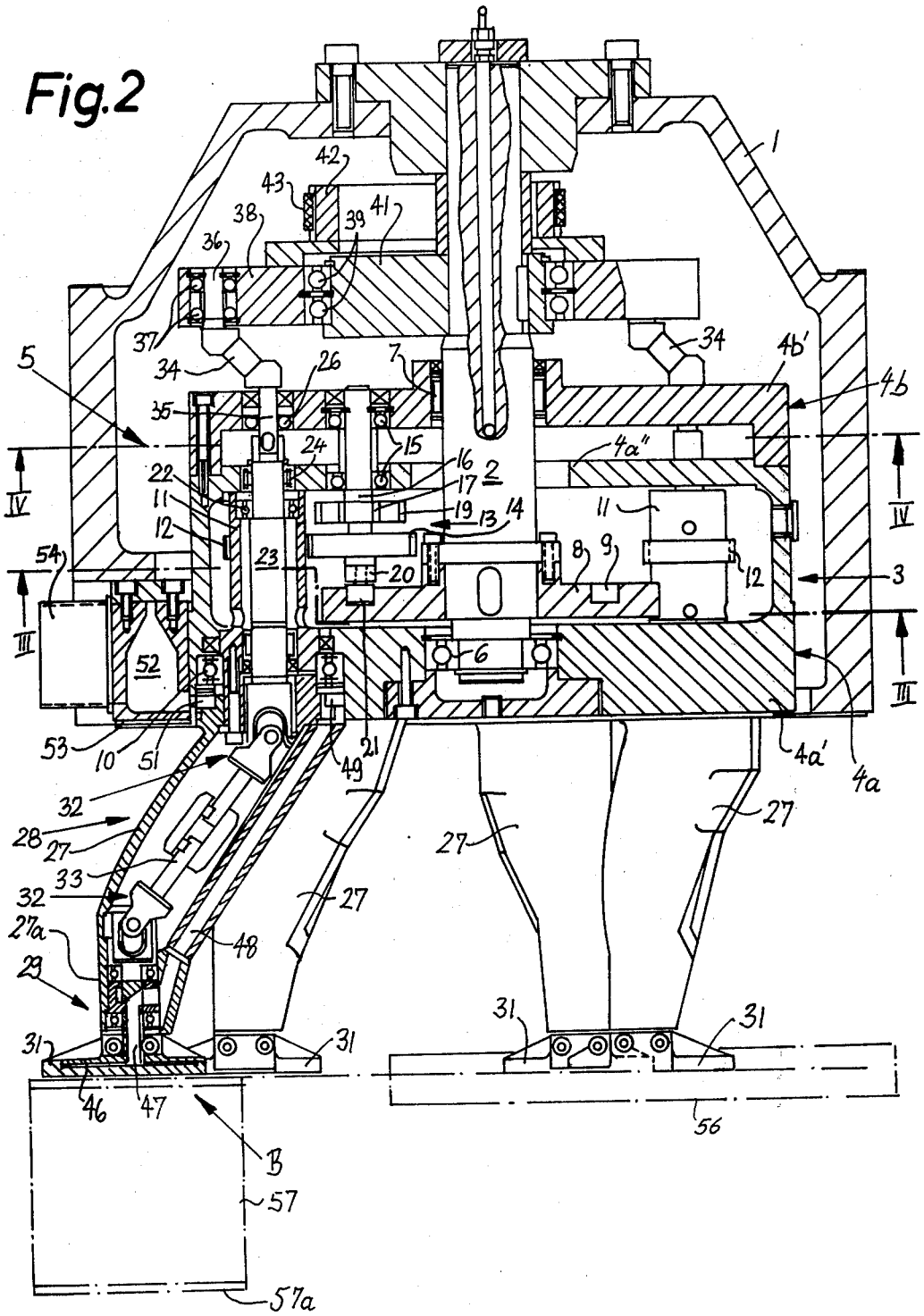
FIG. 2 is a sectional view as seen in the direction of arrows from the line II—II of FIG. 1.

The transfer apparatus of the present invention comprises a stationary housing or frame 1 supporting a fixed shaft 2 for a hollow carrier 3 including two cupped sections 4*a* and 4*b*. A needle bearing 7 is interposed between the section 4*b* and the shaft 2, and a ball bearing 6 is installed between the section 4*a* and the shaft 2. The carrier 3 contains a stationary face cam 8 which is rigidly affixed to the shaft 2 and the upper side of which (as viewed in FIG. 2) has an endless cam groove 9.

The section 4*a* of the carrier 3 has an end wall or bottom wall 4*a*' formed with seven equidistant holes whose axes are parallel to the axis of the shaft 2 and each of which contains a ball bearing 10 for a discrete tubular element or sleeve 11 having an external gear 12. The gears 12 constitute component parts of gear transmissions 13, one for each of the seven sleeves 11. The transmissions 13 form part of a main transmission or rotating means 5 which further includes the aforementioned cam 8. Each of the transmissions 13 further comprises a second gear 14 which mates with the respective gear 12 and is secured to an intermediate shaft 16 mounted in cantilever fashion in two ball bearings 15 one of which is installed in the bottom wall 4*b*′ of the section 4*b* and the other of which is installed in a top wall 4*a*″ of the section 4*a* (this can be readily seen in the left-hand portion of FIG. 2). The intermediate shafts 16 further carry third gears or pinions 17 mating with fourth gears 19 secured to pivot members 18. Each pivot member 18 is mounted in the sections 4*a*, 4*b* of the carrier 3, preferably in cantilever fashion and by means of two antifriction bearings in a manner as explained in connection with the shafts 16 for the gears 14, 17. The bearings for the pivot members 18 are not specifically shown in the drawing. Each pivot member 18 is rigidly connected to (so that it rotates with) a discrete lever 20 (see also FIG. 3) serving to support a roller follower 21 which extends into the endless groove 9 of and thereby tracks the stationary cam 8 so that the angular positions of the pivot members 18 change in automatic response to rotation of the carrier 3 about the axis of the stationary shaft 2.

Each sleeve 11 spacedly surrounds an additional shaft 23 which is coaxial therewith. The sleeves 11 are rotatable on the outer races of suitable ball bearings 22 or other types of antifriction bearings which are mounted on the respective shafts 23 as shown in the left-hand portion of FIG. 2. Each shaft 23 is rotatable in a needle bearing 24 which is installed in the section 4*a* of the carrier 3. As can also be seen in the left-hand portion of FIG. 2, each sleeve 11 is further rigidly connected with a suitably inclined crank arm 28 which constitutes a hollow lever and includes two mutually inclined portions 27 and 27*a*. The free ends 29 of portions 27*a* of the crank arms 28 are provided with receiving means 31 (e.g., relatively narrow and elongated trough-shaped receptacles) for rod-shaped articles C (e.g., plain cigarettes of double unit length). Each receiving means 31 is connected with the corresponding shaft 23 by a torque transmitting connection including a cardanic shaft 33 of ajdustable length and two universal joints 32, one between the corresponding shaft 23 and the adjacent end portion of the shaft 33, and the other between the corresponding receiving means 31 and the respective end portion of the shaft 33. The torque transmitting means 32, 33, 32 are installed in the interior of the respective hollow crank arms 28.

That end portion of each shaft 23 which is remote from the respective cardanic shaft 33 is non-rotatably connected with a rotating means which comprises a crank unit including a crank arm 34, a first crank pin 35 which is coaxial with and shares the angular movements of the shaft 23, and a second crank pin 36 which is rotatable in two ball bearings 37 installed in a disc-shaped holder 38. The crank pins 35 are rotatable in ball bearings 26 or other types of antifriction bearings which are installed in the wall 4*b*′ of the section 4*b*. The holder 38 is rotatable on two ball bearings 39 which surround a ring 41 non-rotatably secured to the shaft 2. The ring 41 is eccentric with reference to the shaft 2, and its eccentricity matches the distance between the axes of two associated crank pins 35, 36.

The holder 38 is rigid with a sprocket wheel 42 which is driven by a toothed belt 43 receiving motion from the main prime mover of the cigarette making machine serving to supply cigarettes C of double unit length. Suitable machines are produced by the assignee of the present application and are known as GARANT and SE 80.

The receiving means 31 are provided with preferably pneumatically operated means for retaining the rod-shaped articles C during transfer from a first station A to a second station B. The retaining means include suction ports or slits 46 which communicate with the flutes of the respective receiving means 31 as well as with channels 47 for evacuation of air from the ports 46 in certain angular positions of the respective receiving means 31. Each channel 47 communicates with one end of a channel 48 which is machined into the respective crank arm 28 and the other end of which communicates with a ring-shaped chamber 49 defined by the respective crank arm 28 and the section 4*a* of the carrier 3. Each chamber 49 may form part of one of the seven bores machined into the section 4*a* for the corresponding sleeves 11 and portions 27 of crank arms 28. The section 4*a* has openings 51 which connect the chambers 49 with a suction chamber 52 provided in a valving element 53 which is secured to the housing 1. The reference character 54 denotes a suction pipe which is connected to a suction generating device 54*a*, e.g., a suction fan or the like.

The means for supplying rod-shaped articles C to the station A comprises a prismatic trough 56 which forms part of or receives articles from the cigarette making machine. The trough 56 constitutes a guide means wherein the articles C advance lengthwise, i.e., axially and in a direction to the left, as viewed in FIG. 1. The means for accepting and transporting transferred articles C sideways comprises a rotary drum-shaped conveyor 57 having axially parallel peripheral flutes 57*a* which receive articles C from the oncoming receiving means 31. The station at which the flutes 57*a* of the conveyor 57 receive articles C from successive receiving means 31 is the station B (see FIG. 1).

Figure 1:
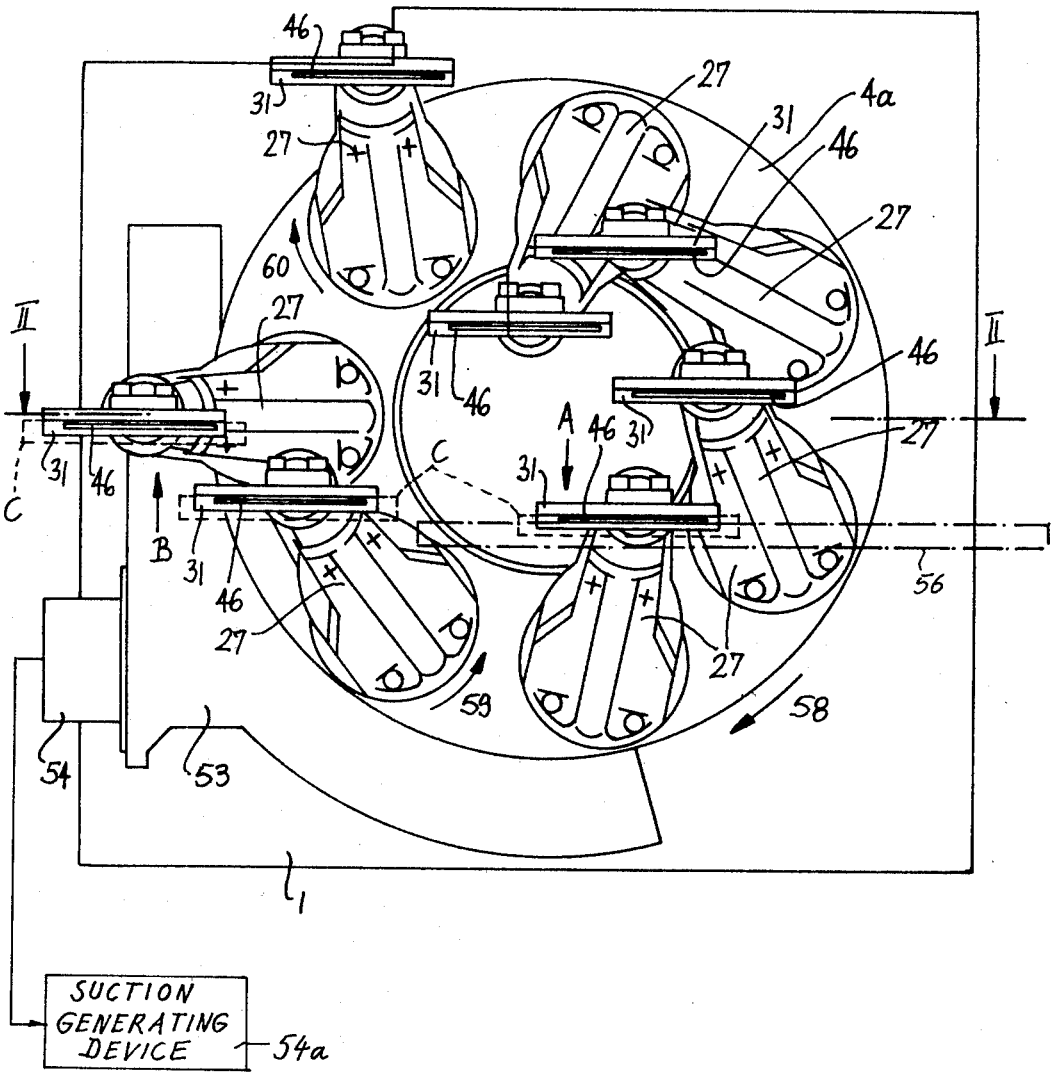
FIG. 1 is a schematic elevational view of a transfer apparatus which embodies the invention.
Figure 3:
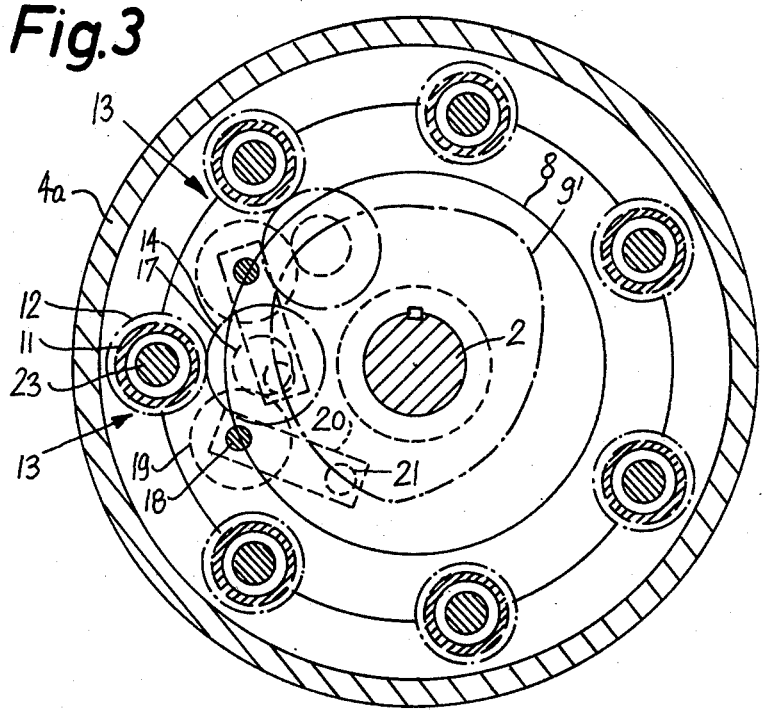
FIG. 3 is a fragmentary sectional view as seen in the direction of arrows from the line III—III of FIG. 2.
Figure 4:
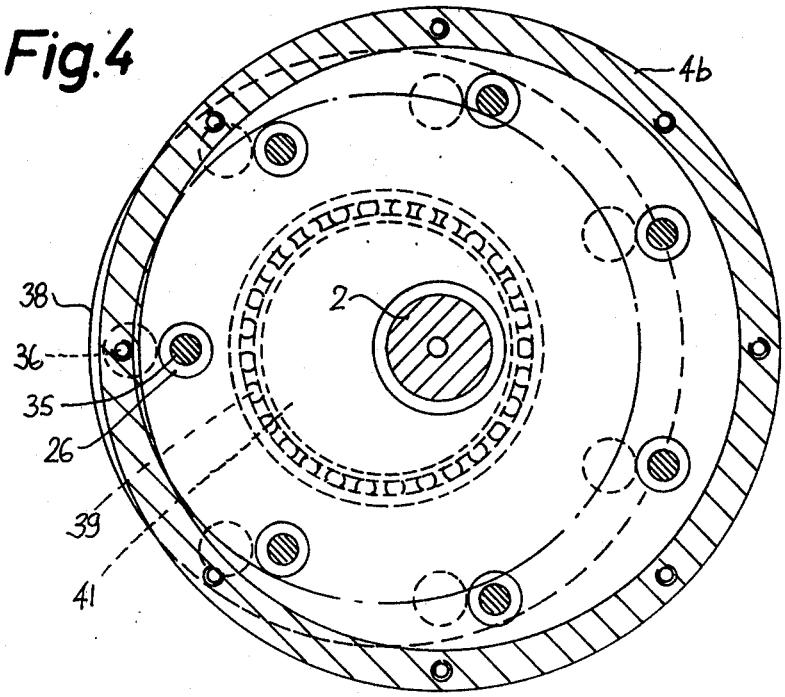
FIG. 4 is a similar fragmentary sectional view as seen in the direction of arrows from the line IV—IV of FIG. 2.

The operation of the transfer apparatus is as follows: The belt 43 receives motion from the main prime mover of the cigarette making machine and rotates the holder 38 through the medium of the sprocket wheel 42. The direction in which the holder 38 rotates is indicated by the arrow 58 shown in FIG. 1. The holder 38 rotates the carrier 3 (i.e., the sections 4*a* and 4*b*) in the same direction through the medium of the seven crank units 34, 35, 36. The roller followers 21 on the levers 20 travel along the cam groove 9, i.e., along an endless path the outline of which is indicated by FIG. 3 by a phantom line 9′. This means that the levers 20 pivot back and forth during orbital movement about the axis of the stationary shaft 2. Such pivotal movements of the levers 20 are transmitted to the corresponding sleeves 11 by way of the respective bears 19, 17, 14 and 12 at a stepped up ratio determined by the transmissions 13 whereby the sleeves 11 cause the associated crank arms 28 to turn back and forth as indicated by the arrows 59 and 60 shown in FIG. 1. The crank units 34, 35, 36 cooperate with the associated shafts 23, joints 32 and cardanic shafts 33 to prevent any changes in orientation of the receiving means 31 while such receiving means orbit about the axis of the shaft 2, i.e., the flutes of the receiving means 31 remain parallel to the axes of rod-shaped articles C which are supplied by the trough 56 of the cigarette making machine. As can be readily seen in FIG. 1, the receiving means 31 travel along an endless path whose curvature is less pronounced during travel of such receiving means from the station A (acceptance of discrete rod-shaped articles C) toward the station B and more pronounced during return movement of successive receiving means from the station B toward the station A. The configuration of the just mentioned endless path can be readily selected in such a way that the articles C which travel from the station A toward the station B are not subjected to excessive stresses, especially axial stresses which arise as a result of deceleration of successive articles during transfer from the trough 56 into the oncoming flutes 57*a* of the receiving conveyor 57. The configuration of the groove 9 in the stationary cam 8 is such that the tangential velocity of the receiving means 31 (note that the rotary movement of crank arms 28 in the direction of arrow 59 is superimposed upon the rotary movement of the carrier 3 in the direction of arrow 58) is at a maximum value when the receiving means are located at a minimum distance from the shaft 2 for the carrier 3 and that the tangential velocity is reduced to a minimum when the distance between the receiving means 31 and the axis of the shaft 2 increases to the maximum value. The trough 56 delivers successive rod-shaped articles C in such a way that an article C which arrives at the station A is tangential to the path of movement of the empty flute of the oncoming receiving means 31. Such article is accepted and retained by the flute because the latter then communicates with the suction generating device 54*a* by way of the corresponding port or ports 46. The tangential velocity of receiving means 31 at the station A is relatively high so as to ensure that the freshly removed article C is moved away from the next-following article in the trough 56 whereby the apparatus reduces the likelihood of interference between the movements of successive articles. Otherwise stated, an article C which is engaged by an oncoming receiving means 31 is moved axially and away from the next-following article so that the articles C which are in the process of being transferred from the station A to the station B can be readily staggered with reference to each other during that stage of orbital movement of receiving means 31 which takes place between the stations A and B (as considered in the direction of arrow 58). FIG. 1 shows that, when the apparatus comprises seven equidistant receiving means 31, one such receiving means is about to receive an article C at the station A, the immediately receiving means 31 is located somewhere between the stations A and B, and the next-preceding receiving means 31 is located at or close to the station B. The staggering of successive articles C, as considered in their axial direction, decreases continuously during the last stage of transfer onto the conveyor 57 so that the flutes 57*a* which move away from the station B transport a row of articles C which move sideways and are accurately or at least substantially accurately aligned with each other. The velocity of articles C which arrive at the station B is a fraction of the velocity of articles leaving the station A. Once a receiving means 31 advances beyond the station B, the corresponding crank arm 28 changes the direction of its angular movement with reference to the carrier 3 (compare the arrows 59 and 60 in FIG. 1). The configuration of the groove 9 in the region between the stations B and A (as considered in the direction of the arrow 58) is such that the cam 8 positively prevents any interference between movements of successive crank arms 28 from the station B and back to the station A. In fact, the configuration of the corresponding portion of the endless cam groove 9 is or can be selected exclusively with a view to prevent such interference during return movement of successive receiving means 31 to the station A. The crank arms 28 begins to turn relative to the carrier 3 in the direction of arrow 59 before the corresponding receiving means 31 reach the station A.

An important advantage of the improved transfer apparatus is that the levers 20 and gear transmissions 13 render it possible to move the receiving means 31 along a path which is most satisfactory under the existing circumstances. Furthermore, the rather substantial angular movements of receiving means 31 about the axes defined therefor by the portions 27*a* of the associated crank arms 28 can be controlled and initiated by a cam (8) rather than by planetaries as in many heretofore known apparatus. Another important advantage of the improved apparatus is that the just mentioned substantial angular movements of the receiving means 31 can be achieved by resorting to a relatively small and compact apparatus; this is attributable to the provision of aforediscussed rotating means 5 with its tubular elements 11 and gear trains 12, 14, 17, 19, cam 8 and levers 20. The tubular elements 11 further allow for the provision of relatively simple and compact means (38, 36, 35, 34, 23, 32, 33, 32) for preventing changes in orientation of receiving means 31 during orbital movement about the axis of the shaft 2. Furthermore, such preventing means operates practically without any play and thus ensures that each and every receiving means 31 is always held in an optimum orientation with reference to the trough 56 and flutes 57*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for transferring cigarettes or analogous rod-shaped articles between first and second stations at which the articles respectively advance axially and sideways at different first and second speeds, comprising a rotary carrier; a plurality of crank arms having first portions rotatably mounted on said carrier and second portions; article receiving means connected with and movable relative to the second portions of said crank arms and arranged to travel, in response to rotation of said carrier, along an endless path having spaced apart first and second portions respectively adjacent to said first and second stations; means for preventing charges in orientation of said receiving means in response to rotation of said carrier; and means for rotating said first portions of said crank arms relative to said carrier in response to rotation of said carrier, comprising stationary cam means, discrete lever means for each of said crank arms, each of said lever means being pivotable with reference to said carrier and having means for tracking said cam means so that said lever means pivot back and forth in response to rotation of said carrier, and transmission means for rotating said crank arms relative to said carrier in response to pivoting of the respective lever means.

2. The apparatus of claim 1, wherein each of said transmission means comprises a gear train.

3. The apparatus of claim 1, wherein each of said transmission means comprises a tubular element rotatably mounted in said carrier and connected with the first portion of the respective crank arm, a first gear provided on said tubular element, an intermediate shaft rotatably mounted in said carrier, a second gear mounted on said intermediate shaft and meshing with said first gear, a third gear provided on said intermediate shaft, and a fourth gear rotatable by the respective lever means and meshing with said third gear.

4. The apparatus of claim 3, wherein the axis of each fourth gear coincides with the pivot axis of the respective lever means.

5. The apparatus of claim 3, wherein said means for preventing changes in orientation of said receiving means comprise additional shafts rotatably mounted in the respective tubular elements, means for transmitting torque from said additional shafts to the respective receiving means, and means for rotating said additional shafts relative to the corresponding tubular elements, including a discrete crank unit for each of said additional shafts, each of said crank units having a crank pin eccentric to the respective additional shaft, a holder eccentric to and rotatable relative to said carrier, and means for rotating said holder whereby said holder cooperates with said carrier to change the angular positions of said crank units and of the associated additional shafts in response to rotation of said carrier and said holder.

6. The apparatus of claim 5, wherein said carrier is arranged to rotate in response to rotation of said holder so that said crank units transmit torque from said holder to said carrier.

7. The apparatus of claim 5, wherein each of said crank arms is hollow and each of said torque transmitting means is installed in the interior of the respective crank arm.

8. The apparatus of claim 7, wherein each of said torque transmitting means comprises at least one universal joint.

9. The apparatus of claim 7, wherein each of said torque transmitting means comprises a pair of universal joints and a cardanic shaft therebetween, one of said joints transmitting torque from the respective additional shaft to the associated cardanic shaft and the other of said joints transmitting torque from the cardanic shaft to the respective receiving means.

10. The apparatus of claim 1, wherein said receiving means include pneumatically operated means for retaining articles therein during travel of such receiving means from one of said stations to the other of said stations.

11. The apparatus of claim 1, wherein said endless path has a first curvature in the region of said first portion and a different second curvature in the region of said second portion thereof.

12. The apparatus of claim 1, wherein said cam means comprises a face cam having an endless cam groove and said tracking means comprises follower means provided on said lever means and extending into said groove.

13. The apparatus of claim 1, wherein said carrier is hollow and said cam means and said lever means are installed in the interior of said carrier.

* * * * *